US006581389B2

(12) United States Patent
Rudick

(10) Patent No.: US 6,581,389 B2
(45) Date of Patent: Jun. 24, 2003

(54) MERCHANDISER USING SLIDE-OUT STIRLING REFRIGERATION DECK

(75) Inventor: Arthur G. Rudick, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/813,628

(22) Filed: Mar. 21, 2001

(65) Prior Publication Data

US 2002/0134089 A1 Sep. 26, 2002

(51) Int. Cl.[7] ..... F25B 9/00
(52) U.S. Cl. ..... 62/6; 62/448
(58) Field of Search ..... 62/6, 448

(56) References Cited

U.S. PATENT DOCUMENTS

| | | | | |
|---|---|---|---|---|
| 1,815,170 | A | 7/1931 | Summers | |
| 2,095,008 | A | 10/1937 | Philipp | 62/115 |
| 2,342,299 | A | 2/1944 | Peet | 225/40 |
| 2,470,547 | A | 5/1949 | Childers | 62/103 |
| 2,512,545 | A | 6/1950 | Hazard | 62/125 |
| 2,660,037 | A | 11/1953 | Cooper | 62/116 |
| 2,672,029 | A | 3/1954 | Saunders | 62/117.2 |
| 2,885,142 | A | 5/1959 | Eberhart | 230/117 |
| 2,961,082 | A | 11/1960 | Hanson et al. | 194/13 |
| 3,004,408 | A | 10/1961 | Dros et al. | 62/419 |
| 3,206,943 | A | 9/1965 | Rice et al. | |
| 3,230,733 | A | 1/1966 | Rutishauser et al. | 62/256 |
| 3,302,429 | A | 2/1967 | Byrd | 62/514 |
| 3,712,078 | A | 1/1973 | Maynard et al. | 62/448 |
| 3,853,437 | A | 12/1974 | Horn et al. | 418/61 |
| 3,997,028 | A | 12/1976 | Lopez | 186/1 |
| 4,037,081 | A | 7/1977 | Aldridge et al. | 219/387 |
| 4,037,650 | A | 7/1977 | Randall | 165/29 |
| 4,138,855 | A | 2/1979 | Jahan et al. | 62/112 |
| 4,176,526 | A | 12/1979 | Missimer | 62/278 |
| 4,176,529 | A | 12/1979 | Stierlin et al. | 62/490 |
| 4,259,844 | A | 4/1981 | Sarcia et al. | 62/6 |
| 4,275,705 | A | 6/1981 | Schaus et al. | 126/110 R |
| 4,306,613 | A | 12/1981 | Christopher | 165/32 |
| 4,377,074 | A | 3/1983 | Jardine | 62/183 |
| 4,383,421 | A | 5/1983 | Quesnoit | 62/333 |

(List continued on next page.)

FOREIGN PATENT DOCUMENTS

| | | |
|---|---|---|
| CH | 233-266 | 7/1944 |
| DE | 233 266 | 7/1944 |
| EP | 0 065 995 | 12/1982 |

(List continued on next page.)

OTHER PUBLICATIONS

Lyn Bowman, A Technical Introduction to Free–Piston Stirling Cycle Machines: Engines, Coolers, and Heat Pumps, May, 1993, pp. 1–7.

(List continued on next page.)

*Primary Examiner*—Denise L. Esquivel
*Assistant Examiner*—Malik N. Drake
(74) *Attorney, Agent, or Firm*—Sutherland Asbill & Brennan LLP

(57) ABSTRACT

A refrigerator. The refrigerator may include a cabinet and a refrigeration deck slidably positioned within the cabinet. The refrigeration deck may include a Stirling cooler unit.

30 Claims, 6 Drawing Sheets

U.S. PATENT DOCUMENTS

| | | | | |
|---|---|---|---|---|
| 4,416,122 | A | 11/1983 | Johnson | 62/448 |
| 4,471,633 | A | 9/1984 | Tinsler | 62/295 |
| 4,480,445 | A | 11/1984 | Goldstein | 62/434 |
| 4,490,991 | A | 1/1985 | Griffin | 62/279 |
| 4,539,737 | A | 9/1985 | Kerpers et al. | 29/423 |
| 4,554,797 | A | 11/1985 | Goldstein | 62/434 |
| 4,558,570 | A | 12/1985 | Shtrikman et al. | 62/6 |
| 4,694,650 | A | 9/1987 | Vincent | 60/520 |
| 4,726,193 | A | 2/1988 | Burke et al. | 62/3 |
| 4,759,190 | A | 7/1988 | Trachtenberg et al. | 62/3 |
| 4,783,968 | A | 11/1988 | Higham et al. | 62/6 |
| 4,811,563 | A | 3/1989 | Furuishi et al. | 60/517 |
| 4,823,554 | A | 4/1989 | Trachtenberg et al. | 62/3 |
| 4,827,733 | A | 5/1989 | Dinh | 62/305 |
| 4,827,735 | A | 5/1989 | Foley | 62/430 |
| 4,831,831 | A | 5/1989 | Carter et al. | 62/59 |
| 4,843,826 | A | 7/1989 | Malaker | 62/6 |
| 4,882,911 | A | 11/1989 | Immel | 62/288 |
| 4,888,951 | A | 12/1989 | Beale | 60/520 |
| 4,922,722 | A | 5/1990 | Kazumoto et al. | 62/6 |
| 4,941,527 | A | 7/1990 | Toth et al. | 165/47 |
| 4,949,554 | A | 8/1990 | Branz et al. | 62/248 |
| 4,964,279 | A | 10/1990 | Osborne | 62/59 |
| 4,977,754 | A | 12/1990 | Upton et al. | 62/248 |
| 4,996,841 | A | 3/1991 | Meijer et al. | 60/525 |
| 5,069,273 | A | 12/1991 | O'Hearne | 165/12 |
| 5,076,351 | A | 12/1991 | Munekawa et al. | 165/104.21 |
| 5,094,083 | A | 3/1992 | Horn et al. | 62/6 |
| 5,142,872 | A | 9/1992 | Tipton | 62/6 |
| 5,228,299 | A | 7/1993 | Harrington et al. | 62/55.5 |
| 5,259,198 | A | 11/1993 | Viegas et al. | 62/7 |
| 5,259,214 | A | 11/1993 | Nagatomo et al. | 62/324.1 |
| 5,284,022 | A | 2/1994 | Chung | 62/6 |
| 5,303,769 | A | 4/1994 | Hoegberg | 165/108 |
| 5,305,825 | A | 4/1994 | Roehrich et al. | 165/64 |
| 5,309,986 | A | 5/1994 | Itoh | 165/104.26 |
| 5,311,927 | A | 5/1994 | Taylor et al. | 165/64 |
| 5,333,460 | A | 8/1994 | Lewis et al. | 62/6 |
| 5,341,653 | A | 8/1994 | Tippmann et al. | 62/288 |
| 5,347,827 | A | 9/1994 | Rudick et al. | 62/440 |
| 5,402,654 | A | 4/1995 | Rudick et al. | 62/448 |
| 5,406,805 | A | 4/1995 | Radermacher et al. | 62/81 |
| 5,417,079 | A | 5/1995 | Rudick et al. | 62/253 |
| 5,417,081 | A | 5/1995 | Rudick et al. | 62/440 |
| 5,438,848 | A | 8/1995 | Kim et al. | 62/342 |
| 5,440,894 | A | 8/1995 | Schaeffer et al. | 62/203 |
| 5,493,874 | A | 2/1996 | Landgrebe | 62/457.2 |
| 5,496,153 | A | 3/1996 | Redlich | 417/212 |
| 5,524,453 | A | 6/1996 | James | 62/434 |
| 5,525,845 | A | 6/1996 | Beale et al. | 310/30 |
| 5,537,820 | A | 7/1996 | Beale et al. | 60/517 |
| 5,542,257 | A | 8/1996 | Mattern-Klosson et al. | 62/55.5 |
| 5,551,250 | A | 9/1996 | Yingst et al. | 62/234 |
| 5,596,875 | A | 1/1997 | Berry et al. | 62/6 |
| 5,638,684 | A | 6/1997 | Siegel et al. | 62/6 |
| 5,642,622 | A | 7/1997 | Berchowitz et al. | 62/6 |
| 5,645,407 | A | 7/1997 | Kralick et al. | 417/383 |
| 5,647,217 | A | 7/1997 | Penswick et al. | 62/6 |
| 5,647,225 | A | 7/1997 | Fischer et al. | 62/434 |
| 5,649,431 | A | 7/1997 | Schroeder, Jr. | 62/434 |
| 5,655,376 | A | 8/1997 | Price | 62/6 |
| 5,678,409 | A | 10/1997 | Price | 62/6 |
| 5,678,421 | A | 10/1997 | Maynard et al. | 62/407 |
| 5,724,833 | A | 3/1998 | Devers | 62/625 |
| 5,735,131 | A | 4/1998 | Lambright, Jr. et al. | 62/99 |
| 5,782,106 | A | 7/1998 | Park | 62/452 |
| 5,794,444 | A | 8/1998 | Hofbauer et al. | 60/517 |
| 5,878,581 | A | 3/1999 | DeFrances et al. | 62/50.2 |
| 5,881,566 | A | 3/1999 | Shacklock et al. | 62/277 |
| 5,895,033 | A | 4/1999 | Ross et al. | 267/161 |
| 5,906,290 | A | 5/1999 | Haberkorn | 220/505 |
| 5,920,133 | A | 7/1999 | Penswick et al. | 310/17 |
| 5,927,079 | A | 7/1999 | Sekiya et al. | 62/6 |
| 5,927,080 | A | 7/1999 | Lee | 62/6 |
| 6,003,319 | A | 12/1999 | Gilley et al. | 62/3.7 |
| 6,023,937 | A | 2/2000 | Rodrigues | 62/295 |
| 6,067,804 | A | 5/2000 | Moeykens et al. | 62/84 |
| 6,073,547 | A | 6/2000 | Westbrooks, Jr. et al. | 99/468 |
| 6,079,481 | A | 6/2000 | Lowenstein et al. | 165/10 |
| 6,112,526 | A | 9/2000 | Chase | 62/6 |
| 6,148,634 | A | 11/2000 | Sherwood | 62/434 |
| 6,158,499 | A | 12/2000 | Rhodes | 165/10 |
| 6,178,770 | B1 | 1/2001 | Bradley, Jr. et al. | 62/434 |
| 6,272,867 | B1 * | 8/2001 | Barrash et al. | 62/6 |
| 6,347,524 | B1 * | 2/2002 | Barrash et al. | 62/6 |

FOREIGN PATENT DOCUMENTS

| | | |
|---|---|---|
| EP | 0 607 746 | 7/1994 |
| EP | 0 1043 554 | 11/2000 |
| FR | 2-609-789 | 7/1988 |
| JP | 64-36468 | 2/1989 |
| JP | 01 269874 | 10/1989 |
| JP | 2-217758 | 8/1990 |
| JP | 7-180921 | 7/1995 |
| JP | 09 096480 | 8/1997 |
| JP | 0 935 063 A2 | 8/1999 |
| JP | 2001 033140 | 9/2001 |
| WO | WO 98/34076 | 8/1998 |

OTHER PUBLICATIONS

B.D. Mennink et al., "Development of an Improved Stirling Cooler for Vacuum Super Insulated Fridges With Thermal Store and Photovoltaic Power Source for Industrialized and Developing Countries," May 10–13, 1994 pp. 1–9.

D.M. Berchowitz et al., "Recent Advances in Stirling Cycle Refrigeration," Aug. 20–25, 1995, 8 pages.

Kelly McDonald et al., "Stirling Refrigerator for Space Shuttle Experiments," Aug. 7/11, 1994; 6 pages.

Sunpower, Inc., "Introduction to Sunpower, Stirling Machines and Free–Piston Technology," Dec., 1995.

D.M. Berchowitz et al., "Test Results for Stirling Cycle Cooled Domestic Refrigerators," Sep. 3–6, 1996, 9 pages.

Royal Vendors, Inc., "G–III All Purpose Vendor Operation and Service Manual," Sep., 1996, pp. 1–67.

D.M. Berchowitz et al., "Stirling Coolers for Solar Refrigerators," 10 pages.

Michael K. Ewert et al., "Experimental Evaluation of a Solar PV Refrigerator with Thermoelectric, Stirling and Vapor Compression Heat Pumps," 7 pages.

D.M. Berchowitz, Ph.D., "Maximized Performance of Stirling Cycle Refrigerators," 8 pages.

David Bergeron, "Heat Pump Technology Recommendation for a Terrestrial Battery–Free Solar Refrigerator," Sep., 1998, pp. 1–25.

Seon–Young Kim, et al., "The Application of Stirling Cooler to Refrigeration," pp. 1023–1026.

R. H. Green, et al., "The Design and Testing of a Stirling Cycle Domestic Freezer," pp. 153–161.

Abstract of Japanese Publication No. 02302563 (Toshiba Corp.) Dec. 14, 1990.

Abstract of Japanese Publication No. 03036468 (Toshiba Corp.) Feb. 18, 1991.

Abstract of Japanese Publication No. 03294753 (Toshiba Corp.) Dec. 25, 1991.

Abstract of Japanese Publication No. 04217758 (Toshiba Corp.) Aug. 7, 1992.
Abstract of Japanese Publication No. 05203273 (Toshiba Corp.) Aug. 10, 1993.
Abstract of Japanese Publication No. 05306846 (Toshiba Corp.) Nov. 19, 1993.
Abstract of Japanese Publication No. 07180921 (Toshiba Corp.) Jul. 18, 1995.
Abstract of Japanese Publication No. 08005179 (Toshiba Corp.) Jan. 12, 1996.
Abstract of Japanese Publication No. 08100958 (Toshiba Corp.) Apr. 16. 1996.
Abstract of Japanese Publication No. 08247563 (Toshiba Corp.) Sep. 27, 1996.

* cited by examiner

MERCHANDISER USING SLIDE-OUT STIRLING REFRIGERATION DECK

TECHNICAL FIELD

The present invention relates generally to refrigeration systems that use a Stirling cooler as the mechanism for removing heat from a desired space. More particularly, the present invention relates to a glass door merchandiser with a slide-out Stirling refrigeration deck.

BACKGROUND OF THE INVENTION

In the beverage industry and elsewhere, refrigeration systems are found in vending machines, glass door merchandisers ("GDM's"), and other types of dispensers and coolers. In the past, these units have used a conventional vapor compression (Rankine cycle) refrigeration apparatus to keep the beverages or the containers therein cold. In the Rankine cycle apparatus, the refrigerant in the vapor phase is compressed in a compressor so as to cause an increase in temperature. The hot, high-pressure refrigerant is then circulated through a heat exchanger, called a condenser, where it is cooled by heat transfer to the surrounding environment. As a result of the heat transfer to the environment, the refrigerant condenses from a gas back to a liquid. After leaving the condenser, the refrigerant passes through a throttling device where the pressure and temperature of the refrigerant are reduced. The cold refrigerant leaves the throttling device and enters a second heat exchanger, called an evaporator, located in or near the refrigerated space. Heat transfer with the evaporator and the refrigerated space causes the refrigerant to evaporate or to change from a saturated mixture of liquid and vapor into a superheated vapor. The vapor leaving the evaporator is then drawn back into the compressor so as to repeat the cycle.

Stirling cycle coolers are also a well known as heat transfer mechanisms. Briefly, a Stirling cycle cooler compresses and expands a gas (typically helium) to produce cooling. This gas shuttles back and forth through a regenerator bed to develop much greater temperature differentials than may be produced through the Rankine compression and expansion process. Specifically, a Stirling cooler uses a displacer to force the gas back and forth through the regenerator bed and a piston to compress and expand the gas. The regenerator bed may be a porous element with a large thermal inertia. During operation, the regenerator bed develops a temperature gradient. One end of the device becomes hot and the other end becomes cold. See David Bergeron, *Heat Pump Technology Recommendation for a Terrestrial Battery-Free Solar Refrigerator*, September 1998. Patents relating to Stirling coolers include U.S. Pat. Nos. 5,678,409; 5,647,217; 5,638,684; 5,596,875 and 4,922,722 (all incorporated herein by reference).

Stirling cooler units are desirable because they are nonpolluting, efficient, and have very few moving parts. The use of Stirling coolers units has been proposed for conventional refrigerators. See U.S. Pat. No. 5,438,848 (incorporated herein by reference). However, it has been recognized that the integration of a free-piston Stirling cooler into a conventional refrigerated cabinet requires different manufacturing, installation, and operational techniques than those used for conventional compressor systems. D. M. Berchowitz et al., *Test Results for Stirling Cycle Cooler Domestic Refrigerators,* Second International Conference. As a result, the use of the Stirling coolers in, for example, beverage vending machines, GDM's, and other types of dispensers, coolers, or refrigerators is not well known.

For example, Stirling coolers by their nature produce a small amplitude vibration. Care must be taken to isolate vibrationally the Stirling cooler unit from the cabinet. If vibrations are transmitted from the Stirling cooler unit to the cabinet, the results may range from an annoying noise to even a potential reduction in the life of the refrigeration device as a whole.

A need exists, therefore, for adapting Stirling cooler unit technology to conventional beverage vending machines, GDM's, dispensers, coolers, refrigerators, and the like. Specifically, the Stirling cooler units used therein should be easily accessible in case of repair or replacement. Preferably, the Stirling coolers should be accessible with a minimum of down time for the enclosure as a whole and without the need for emptying the enclosure. The beverage vending machine, GDM, or other type of dispenser, cooler, or refrigerator with the Stirling cooler units therein should be both easy to use and energy efficient. The Stirling cooler units also should be positioned therein so as to produce a minimum of vibration to the enclosure as a whole.

SUMMARY OF THE INVENTION

The present invention thus provides for a refrigerator. The refrigerator may include a cabinet and a refrigeration deck slidably positioned within the cabinet. The refrigeration deck may include a Stirling cooler unit.

Specific embodiments of the invention may include the use of a number of Stirling cooler units. The Stirling cooler units may be free piston Stirling cooler units. One of the Stirling cooler units may be operated out of phase with a second one of the units so as to cancel out the vibrations produced by all of the Stirling cooler units. The Stirling cooler units may each include a fan, a hot end, and a cold end. A hot air shroud may be positioned adjacent to the hot end and a cold end heat exchanger may be positioned adjacent to the cold end. The cold end heat exchanger may include a plate and a number of fins attached thereto. The cold end of the Stirling cooler unit may be attached to the cold end heat exchanger via an attachment ring.

The cabinet may include a refrigerated space and an air plenum such that the air may circulate through the air plenum between the refrigerated space and the refrigeration deck. The air plenum may include a return air stream and a supply air stream. The refrigeration deck may include a cold air shroud positioned adjacent to the air plenum. The refrigeration deck also may include a fan positioned within the cold air shroud so as to circulate the air through the cabinet and the refrigeration deck.

The refrigeration deck may include a base plate with a number of runners thereon so as to slide the refrigeration deck in and out of the cabinet. The runners each may include an isolation pad. The refrigeration deck also may include a vertical wall extending from the base plate. The vertical wall may include an aperture therein. The aperture may be sized to accommodate a Stirling cooler unit therein. An insulation plug also may be positioned within the aperture.

The refrigeration deck may include an isolation mechanism. The isolation mechanism may support the Stirling cooler unit. The isolation mechanism may include an elastomeric layer positioned on a tray. The Stirling cooler unit may include a pin and a vertical plate with a screw positioned thereon. The tray may include an up-turned tab with an unthreaded hole and a down-turned tab with a threaded hole. The pin may engage the unthreaded hole of the upturned tab and the screw may pass through the vertical plate and into the threaded hole of the down-turned tab.

A further embodiment of the present invention may provide for a refrigerator. The refrigerator may include a cabinet and a refrigeration deck. The refrigeration deck may include a number of Stirling cooler units. One of the Stirling cooler units may be out of phase with a second one of the units so as to cancel out the vibrations produced by the Stirling cooler units as a whole.

The refrigeration deck may include a number of isolation mechanisms. Each of the isolation mechanisms may support one of the Stirling cooler units. Each of the isolation mechanisms may have an elastomeric layer positioned on a tray. The refrigeration deck may have a base plate with a number of isolation pads thereon. The refrigeration deck also may include a vertical wall extending from the base plate. The vertical wall may include an aperture therein. The aperture may be sized to accommodate the Stirling cooler unit therein. The aperture also may include an insulation plug.

A further embodiment of the present invention may provide for a refrigeration deck for a refrigerator. The refrigeration deck may include a surface extending in a first direction and a second surface extending in a second direction. The second surface may be connected to the first surface. The second surface may include an aperture therein and an isolation tray positioned thereon. A Stirling cooler unit may be positioned on the isolation tray and extend through the aperture in the second surface.

These and other objects, features, and advantages of the present invention will become apparent after review of the following detailed description of the disclosed embodiments and the appended drawings and claims.

DETAILED DESCRIPTION OF THE EMBODIMENTS

With reference to the drawings in which like numerals indicate like elements throughout the several views, the present invention utilizes one or more Stirling cooler units 100. The Stirling cooler units 100 in general are well known to those skilled in the art. One type of Stirling cooler unit 100 that may be used in the present invention is a free piston Stirling cooler. For example, the Stirling cooler unit 100 for use herein may be commercially available from Global Cooling, Inc. of Athens, Ohio under the designation "M100B". Other types of Stirling cooler units 100 that may be useful with the present invention are shown in U.S. Pat. Nos. 5,678,409; 5,647,217; 5,638,684; 5,596,875; 5,438,848; and 4,922,722, the disclosures of which are incorporated herein by reference.

Figure 1:
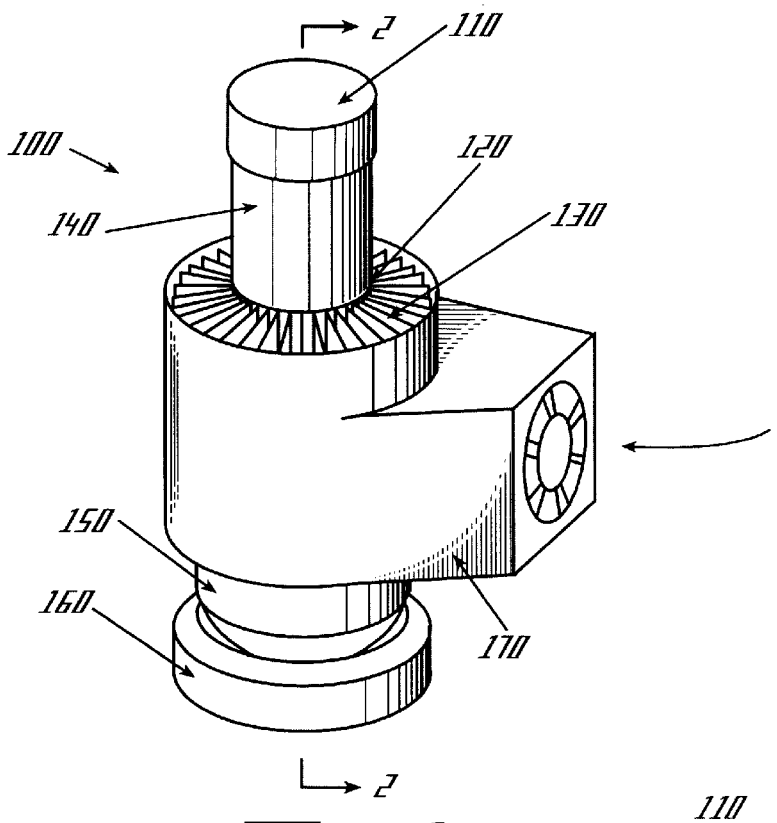
FIG. 1 is a perspective view of a Stirling cooler unit.
Figure 2:
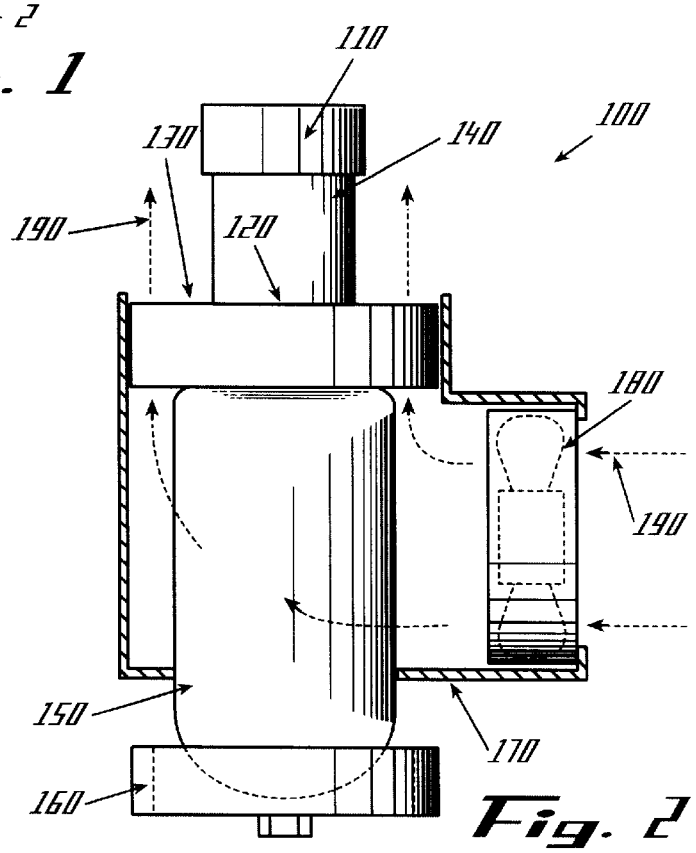
FIG. 2 is a partial cross-sectional view of the Stirling cooler unit taken along line 2—2 of FIG. 1.

As is shown in FIGS. 1 and 2, the Stirling unit 100 may include an acceptor or a cold end 110 and a rejector or a hot end 120. The hot end 120 may be surrounded by a hot end heat exchanger 130. A regenerator 140 may separate the cold end 110 and the hot end 120. The regenerator 140 may include a bed of closely spaced layers of Mylar (polyester film) or similar types of materials. The internal refrigerant may be helium, hydrogen, or similar types of fluids. The Stirling unit 110 may further include a piston 145 driven by a linear motor (not shown). The piston 145 and the linear motor may be positioned within a shell 150. The shell 150, in turn, may be positioned upon a spring mounted balance mass 160. A heat rejection shroud 170 may surround the linear motor and the shell 150. The heat rejection shroud 170 may be made out of plastic, sheet metal, or similar materials. A fan 180, or another type of air movement device, may be positioned within the shroud 170. The fan 180 may direct a flow of ambient air through the hot end heat exchanger 130 as is shown by the arrows 190 in FIG. 2. The fan 180 may have a free air capacity of about thirty (30) to about one hundred ten (110) cubic inches per second. The functions of these internal elements of the Stirling units 100 are well known to those skilled in the art, and therefore, will not be explained further. Likewise, the respective sizes of the Stirling cooler units 100 and the components therein will vary with the specific application and the operating environment.

Figure 3:
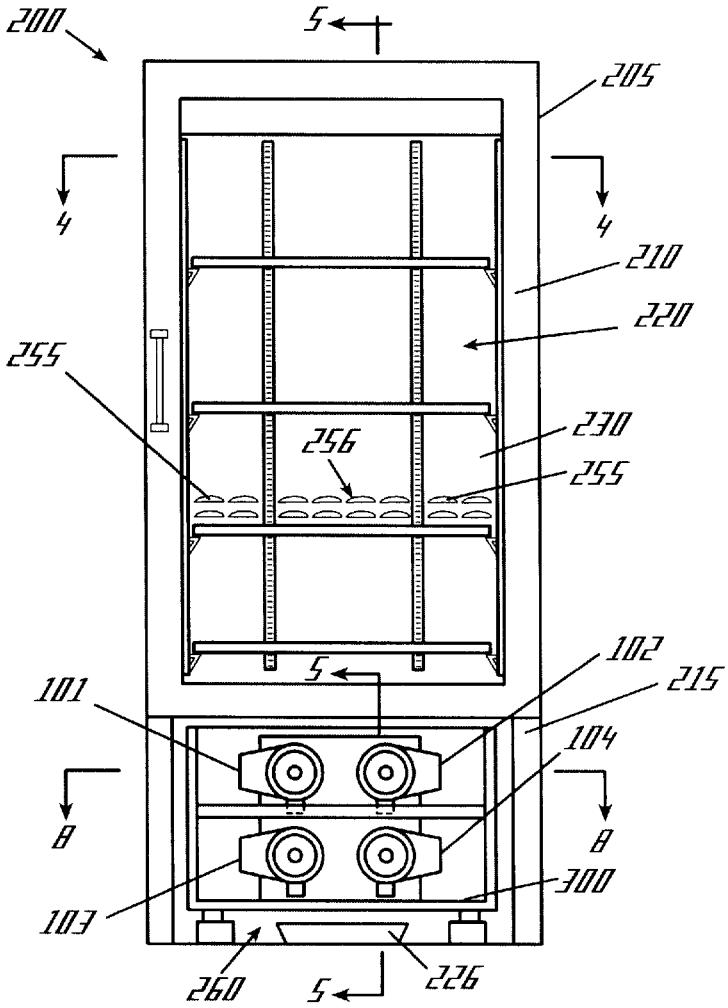
FIG. 3 is a front view of a glass door merchandiser with a slide-out refrigeration deck having four (4) Stirling cooler units therein.
Figure 4:
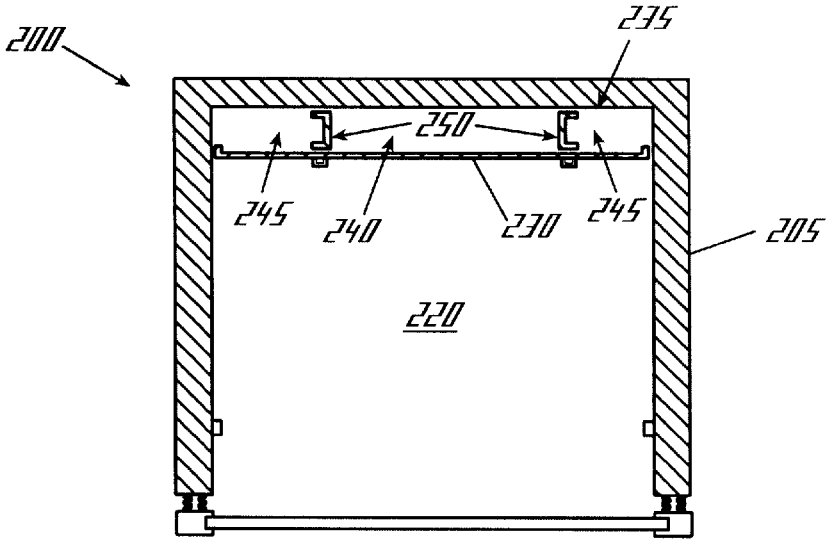
FIG. 4 is a cross-sectional view through the cabinet of the glass door merchandiser taken along line 4—4 of FIG. 3.

FIGS. 3 and 4 show a glass door merchandiser 200 ("GDM 200") for use with the present invention. Although the GDM 200 is shown, the invention also could work with conventional beverage vending machines, other types of beverage dispensers, or any other type of refrigerator or refrigerated space. The GDM 200 may include a cabinet 205 with an upper part 210 and a lower part 215. The cabinet 205 also may include a refrigerated section 220, a refrigeration deck area 225, and a false back 230. Positioned beneath the refrigeration deck area 225 may be a drain pan 226. The drain pan 226 may collect condensate from the operation of the Stirling units 100 as is explained in more detail below. A drain tube 227 extending from the refrigeration deck area 225 may feed condensate to the drain pan 226.

The false back 230 separates the refrigerated section 220 of the cabinet 205 from an air plenum 235. The air plenum 235 may be used to circulate air between the refrigerated section 220 and the refrigeration components within the refrigeration deck area 225 as is described below. The air plenum 235 may include an inside channel 240 and two outside channels 245. Two dividers 250 may separate the channels 240, 245. The false back 230 also may include several louvers 255 positioned adjacent to the outside channels 245. The louvers 255 may allow return air from the refrigerated section 220 to enter the downward flowing air stream back towards the refrigeration components within the refrigeration deck area 225. The false back 230 also may include a number of inside louvers 256 positioned adjacent to the inside channel 240. The inside louvers 256 may allow some of the supply air to leave the upward flowing channel of the air plenum 235 and enter the refrigerated section 220. Although the term "louver" is used herein, any type of air passageway may be employed. Likewise, the respective upwards and downwards air flows may be reversed. The false back 230 may stop short of the top of the upper part 210 of the cabinet 205 so as to allow the remaining upward airflow to enter the refrigerated section 220 of the cabinet 205 and circulate therein.

A refrigeration deck 260 may be positioned within the refrigeration deck area 225 of the lower part 215 of the cabinet 205. As is shown in FIG. 3, four (4) Stirling units 100 may be used within the refrigeration deck 260, a first unit 101, a second unit 102, a third unit 103, and a fourth unit 104. The GDM 200, however, can use any number of Stirling units 100. As described above, the number of Stirling units 100 used may depend on the refrigeration capacity needed for the GDM 200 as a whole and the refrigeration capacity of each Stirling unit 100. The refrigeration deck 260 also may be located in the upper part 210 of the cabinet 205 in the same or a similar manner of installation.

Referring to FIGS. 5 through 8, the refrigeration deck 260 may include a base plate 300. The base plate 300 may be made out of steel, aluminum, or similar types of materials. The base plate 300 may include a number of runners 310 positioned thereon. The runners 310 may be made out of steel, aluminum, or similar types of materials. The runners 310 may allow the base plate 300, and the refrigeration deck 260 as a whole, to slide in and out of the lower part 215 of the cabinet 205. The base plate 300 may be connected the runners 310 via a number of pads 320. The pads 320 may be made from an elastomeric material such as polyurethane, neoprene (polychloroprene), or similar types of materials. The pads 320 may provide or improve vibration isolation for the refrigeration deck 260 as a whole.

The refrigeration deck 260 may include a vertical wall 330 connected to the base plate 300. The vertical wall 330 may be made out of a foam laminated with a steel skin or similar types of materials or structures. The vertical wall 330 may be insulated with expanded polystyrene foam, polyurethane foam, or similar types of materials. The vertical wall 330 may be attached to the base plate 300 and stabilized by one or more side brackets 340. One of the side brackets 340 may be positioned on either side of the vertical wall 330. Also attached to the vertical wall 330 may be a hot air shroud 345. The hot air shroud 345 may be made out of steel, plastic, or similar types of materials. The hot air shroud 345 may include a number of shroud apertures 350 sized to accommodate the Stirling units 100. The hot air shroud 345 also may include a bottom opening 355 that extends through the base plate 300. The bottom opening 355 may assist in circulating the waste heat of the Stirling units 100 as explained in more detail below.

The Stirling units 100 may be attached to the refrigeration deck 260 via the base plate 300 and the vertical wall 330. Specifically, the Stirling units 100 each may rest on a primary vibration isolation mechanism 360. The details of these isolation mechanisms 360 will be described in detail below. The top Stirling units 100 may be supported via the isolation mechanisms 360 by a horizontal bracket 370. The horizontal bracket 370 may be attached at both ends to the side brackets 340. The bottom Stirling units 100 may be supported via the isolation mechanisms 360 attached to the base plate 300.

Each isolation mechanism 360 may include a soft block 400 bonded to a tray 410. The soft block 400 may be made out of a compliant elastomeric material such as polyurethane, neoprene (polychloroprene), or similar types of materials. In the case of the upper Stirling units 100, the soft block 400 may be bonded to and supported by the horizontal bracket 370. In the case of the lower Stirling units 100, the soft block 400 may be bonded to and supported by the base plate 300. As is shown in more detail in FIG. 6, the tray 410 may have an up-turned tab 420 with an unthreaded hole 430 on one end and a down-turned tab 440 with a threaded hole 450 on the other end. A pin 460 may be mounted on one end of the hot air shroud 170 of each Stirling unit 100 while a vertical plate 470 with a screw 480 may be mounted on another end. When the Stirling unit 100 is installed, the pin 460 may engage the unthreaded hole 430 of the up-turned tab 420 and the screw 480 may pass through the vertical plate 470 and into the threaded hole 450 of the down-turned tab 440 so as to secure the unit 100.

The Stirling units 100 also may be attached into and through the vertical wall 330 via a number of cooler apertures 500 positioned therein. Each Stirling unit 100 may be positioned within a cooling aperture 500 such that each cold end 110 extends through the vertical wall 330. Each of the cold ends 110 then may be attached to a cold end heat exchanger 510. The cold end heat exchanger 510 may be of conventional design and may include a plate 520 with a number fins 530 attached thereto. The cold end heat exchanger 510 may be made out of cast aluminum or similar materials with good heat transfer characteristics.

Each Stirling unit 100 may be attached to the cold end heat exchanger 510 via a number of screws 540 and a number of attachment rings 550. Each attachment ring 550 may have flange 560 that surrounds and engages the back end of the cold end 110 of each Stirling unit 100. The attachment ring 550 thus secures the Stirling unit 100 to the cold end heat exchanger 510. Any additional space remaining within the vertical wall apertures 500 may be filled with an insulation plug 570. The insulation plugs 570 may be substantially toroidal in shape and may be made out of a soft compliant foam or other materials with good insulating, vibration, and isolation characteristics.

When the Stirling units 100 are firmly attached to the cold end heat exchanger 510, the units 100 and the heat exchanger 510 may be substantially isolated with respect to vibrations from the remainder of the GDM 200. The only points of contact between the Stirling units 100 and the GDM 200 may include the trays 410, the attachment rings 550, and the insulation plugs 570. Due to the nature of the material therein, the isolation plugs 570 should not transmit significant vibration from the Stirling units 100 to the vertical wall 330. The insulation plugs 570 thus provide the Stirling cooler units 100 with vibration isolation in that the Stirling cooler units 100 and the cold end heat exchanger 520 essentially "float" with the isolation plugs 570.

Figure 7:
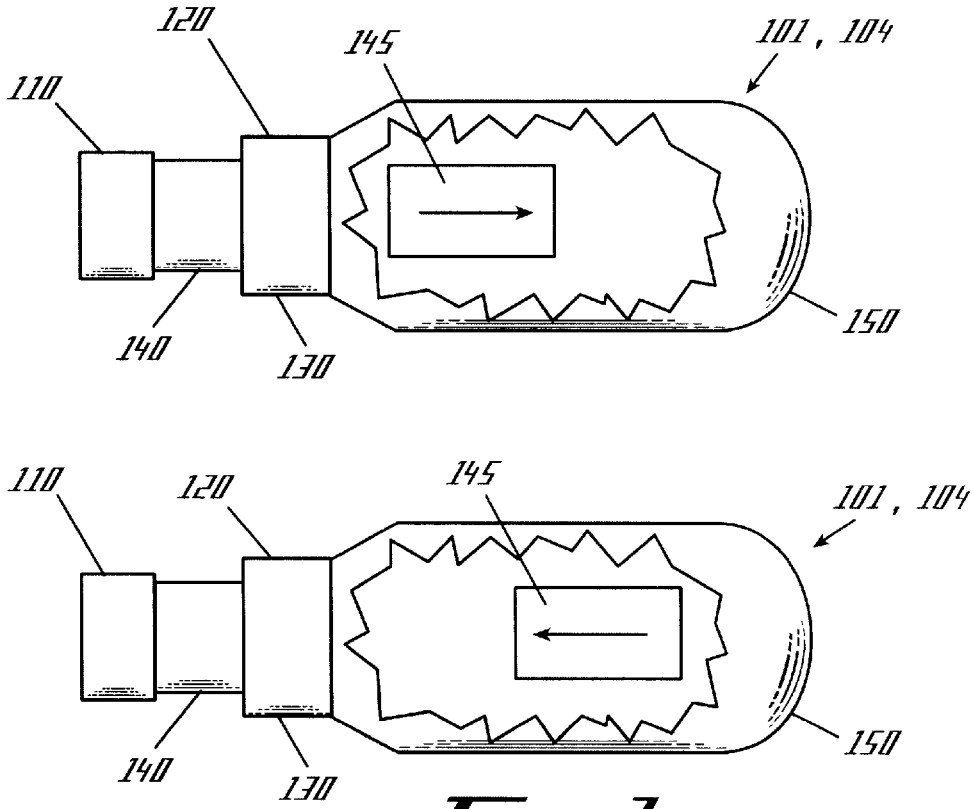
FIG. 7 is a pictorial view of the Stirling cooler units operated out of phase with each other.

Significantly, the respective Stirling units 100 may be positioned within the refrigeration deck 260 such that the units 100 largely cancel out the vibrations of each other. For example, the units 100 on the opposite diagonals may be operated in opposite phases. Specifically, the unit 101 and the unit 104 may operate in one phase while the unit 102 and the unit 103 may operate in the opposite phase, i.e., the units 100 on the opposite diagonals are 180 degrees out of phase with each other. By out of phase, we mean the respective internal piston strokes are reversed as is shown in FIG. 7. Because the vibrations of the units 101, 104 are 180 degrees out of phase with units 102, 103, the vibrations tend to cancel each other out and hence reduce the amount of vibrations transmitted to the GDM 200 as a whole. Changing the phase on the units 100 generally involves flipping the position of an internal connector (not shown) as attached to the incoming power line (not shown).

Figure 8:
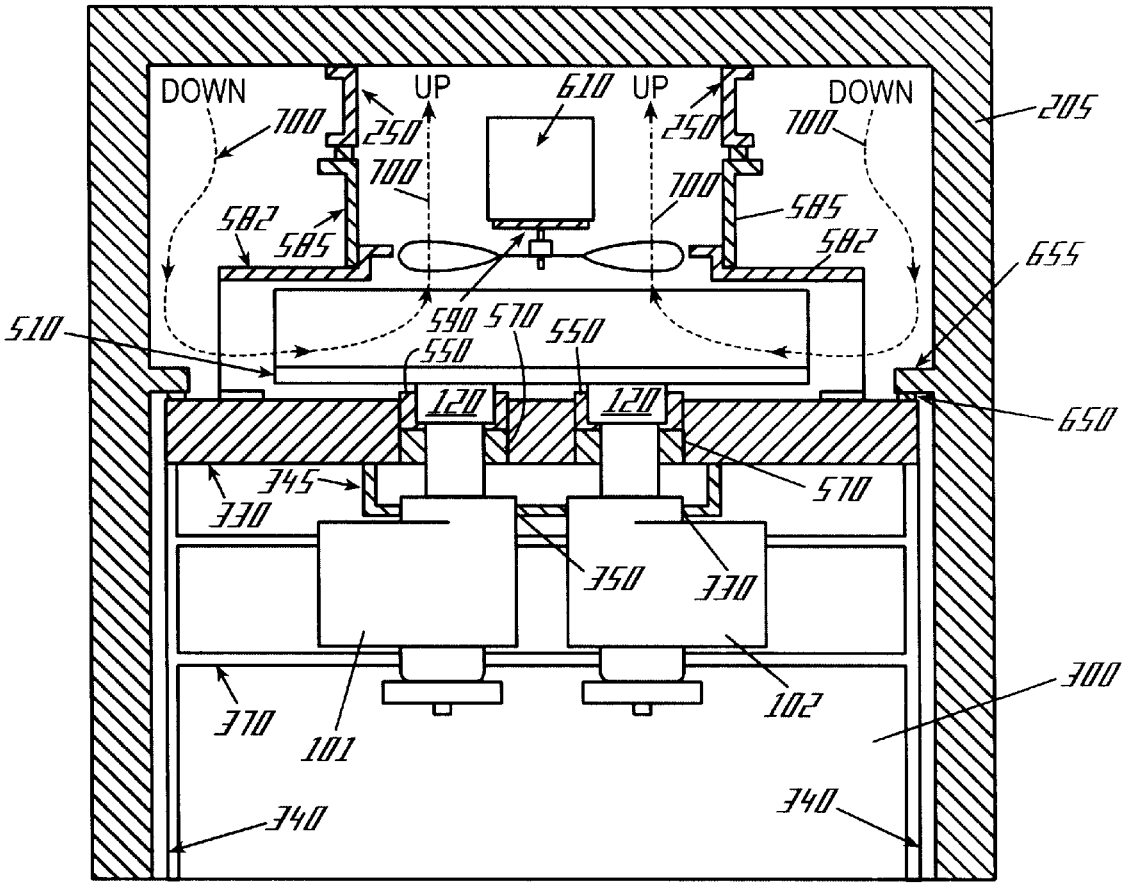
FIG. 8 is a cross-sectional view taken through the cabinet and the refrigeration deck along line 8—8 of FIG. 3.
Figure 9:
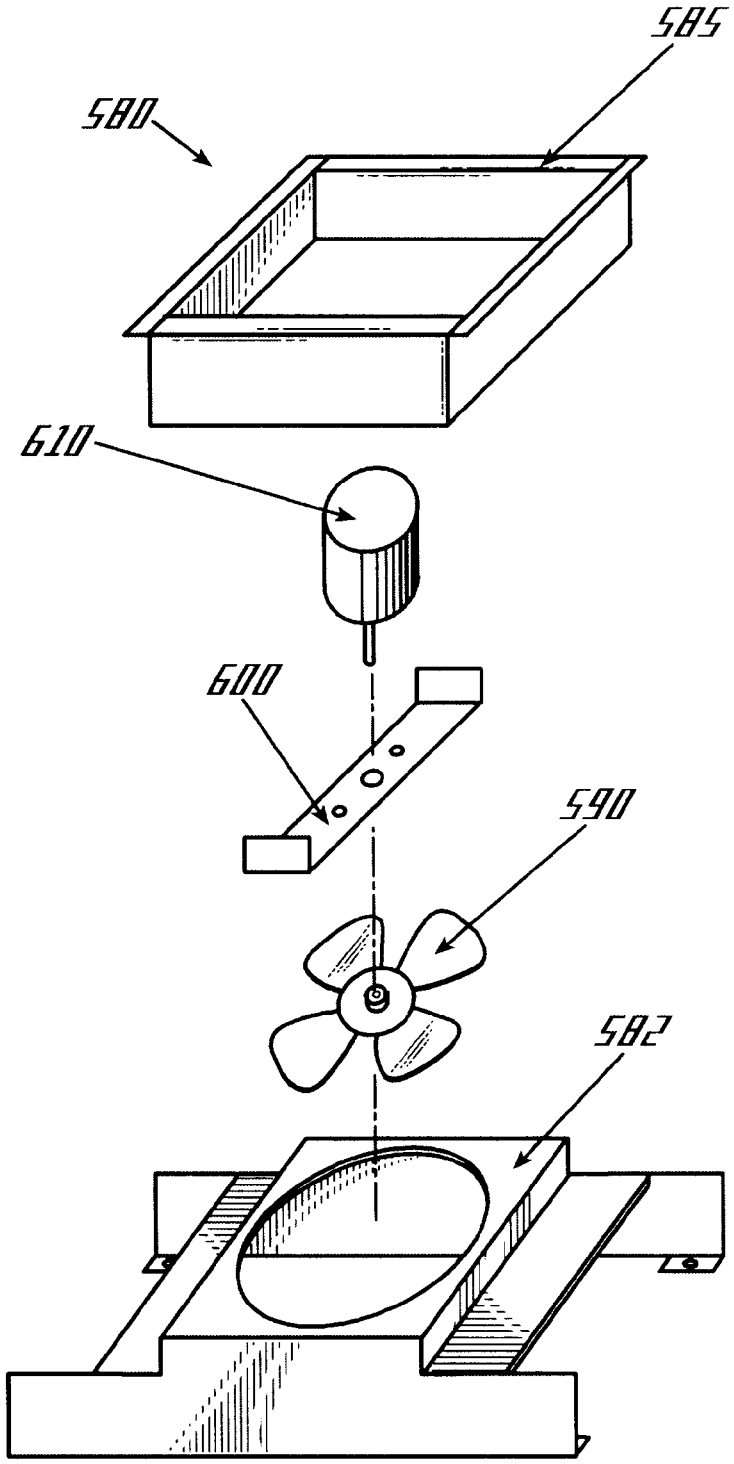
FIG. 9 is an exploded view of the fan and the cold air shroud assembly.

As is shown in FIGS. 8 and 9, a cold air shroud 580 also may be attached to the vertical wall 330. The cold air shroud 580 may include a heat exchanger enclosure 582 and a fan enclosure 585. The enclosures 580, 582 may be joined by conventional means such as pop riveting or other methods. The cold air shroud 580 may be made out of aluminum, steel, or similar types of materials. A fan 590, or another type of air movement device, may be mounted within the cold air shroud 580 by a support bracket 600. Although the term "fan" 590 is used herein, the fan may be any type of air movement device, such as a pump, a bellows, a screw, and the like known to those skilled in the art. The fan 590 may be driven by a conventional electric motor 610. The fan 590 may have a capacity of about 300 to 500 cubic feet per minute.

To insert the Stirling units 100 and the refrigeration deck 260 into the GDM 200, the refrigeration deck 260 may be slid into position within the cabinet 205 by the runners 310 of the base plate 300. The cabinet 205 may contain a primary seal 650 that extends on the perimeter of the lower portion 220 along a seal flange 655. Likewise, the vertical wall 330 of the refrigeration deck 260 may align with the primary seal 650 of the cabinet 205. Further, the cabinet 205 also may have a secondary seal 670 positioned along a secondary seal flange 675 that aligns with the cold air shroud 580 of the refrigeration deck 260. The seals 650, 670 may be made out of neoprene foam (polychloroprene), vinyl extrusion, or similar materials with good insulating characteristics. When the refrigeration deck 260 is completely positioned within the cabinet 205, the primary seal 650 is compressed between the vertical wall 330 and the seal flange 655 while the secondary seal 670 is compressed between the cold air shroud 580 and the secondary seal flange 675. The seals 650, 670 thus form relatively airtight boundaries for thermal efficiency for the GDM 200 as a whole.

In use, air flowing in the outside channels 245 of the air plenum 235 enters into the cold end heat exchanger 510. The air is drawn through the cold end heat exchanger 510 by the fan 590. Heat in the air stream is absorbed by the cold end heat exchanger 510 as the air stream passes through. The air is then directed into the upward flowing inside air channel 240 through the cold air shroud 580. The dashed arrows 700 in FIG. 8 show the general direction of the air stream. The air is then circulated though the refrigerated section 220 of the cabinet 205 and back to the refrigeration deck 260. Any condensate formed about the cold end heat exchanger 510 may pass through the drain tube 227 to the drain pan 226.

Figure 5:
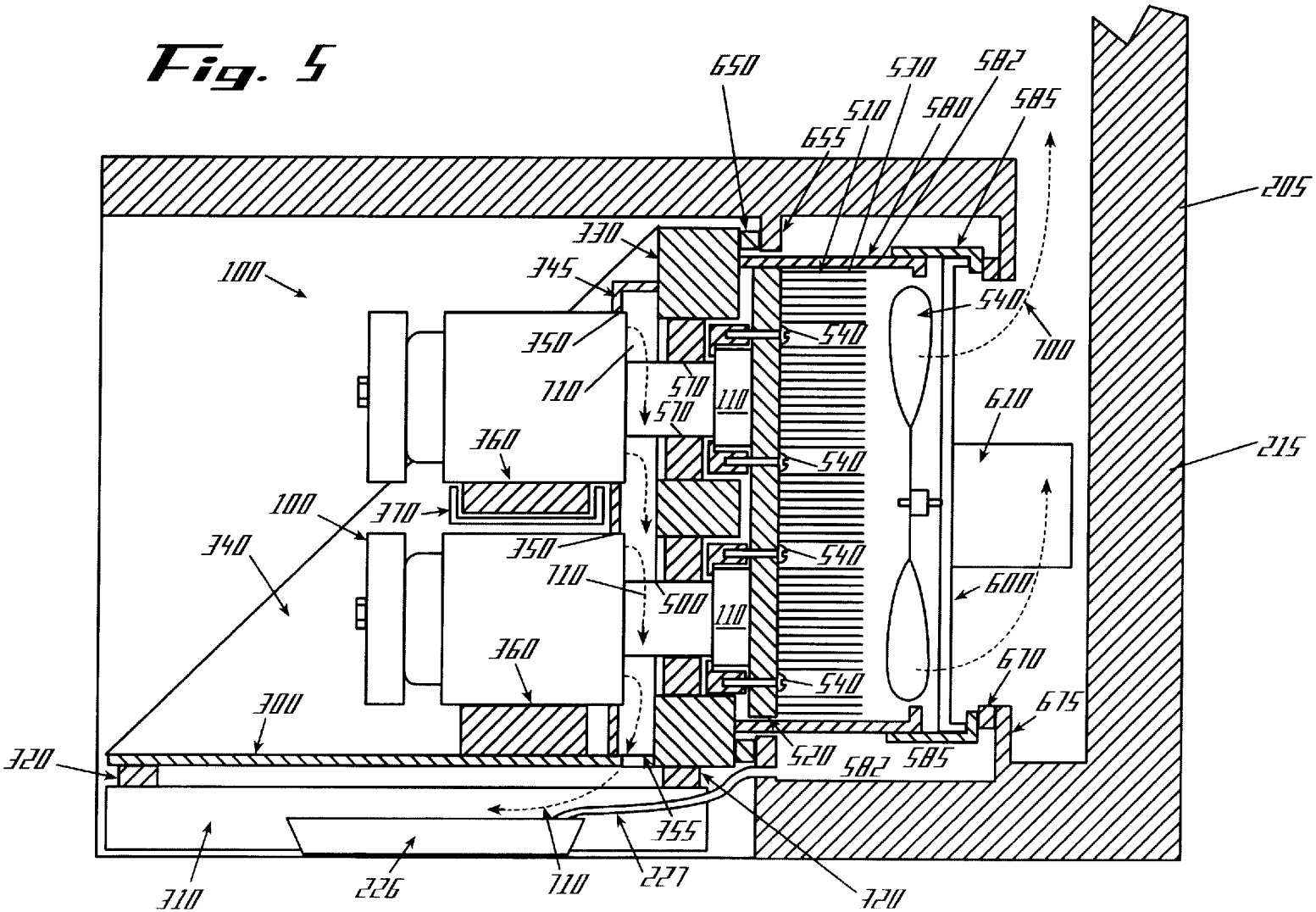
FIG. 5 is a cross-sectional view through the cabinet of the glass door merchandiser and the refrigeration deck taken along line 5—5 of FIG. 3.
Figure 6:
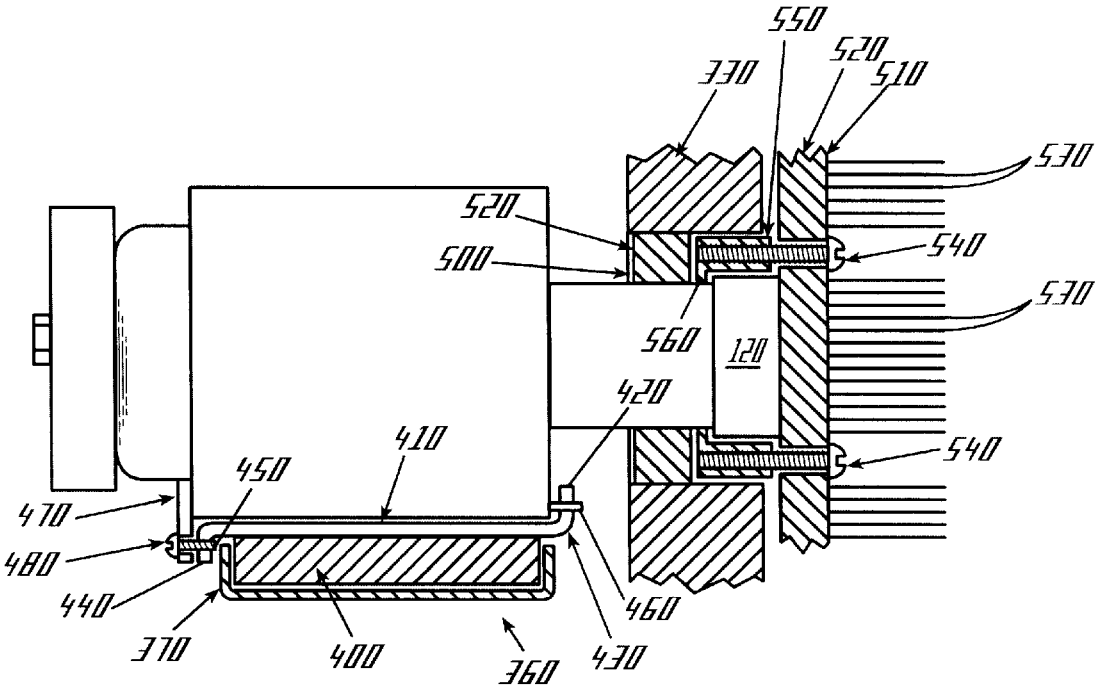
FIG. 6 is an enlarged view of FIG. 5 showing the Stirling cooler unit mounted within the refrigeration deck.

On the opposite side of the vertical wall 330, the hot air shroud 345 directs the waste heat from the Stirling units 100 through the bottom opening 355 in the base plate 300 as is shown by the dashed arrows 710 in FIG. 5. The internal fans 180 of the Stirling units 100 may produce the airflow. The waste heat may circulate over the top of the drain pan 226 so as to evaporate the condensate therein.

In order to remove the Stirling unit 100 and the refrigeration deck 260 as a whole, the refrigeration deck 260 may be slid along the runners 310 of the base plate 300 and removed from the cabinet 205. The refrigerated section 220 need not be emptied of product when removing the refrigeration deck 260. The cold air shroud 580 may then be removed from the vertical wall 330. The individual Stirling unit 100 may then be removed by removing the screws 480, 540. The Stirling unit 100, along with the pin 460, the vertical plate 470, the attachment ring 550, and the insulation plugs 570 may then be removed. A new Stirling unit 100, along with the same components, may then be slid into place. The refrigeration deck 260 may then be replaced in the same manner as described above.

The present invention thus results in a GDM 200 with an easily removable refrigeration deck 260 for access to the Stirling units 100. The invention thus provides the efficiencies of the Stirling units 100 with improved access and versatility. Further, the invention limits the amount of vibration transferred from the Stirling units 100 to the GDM 200 as a whole. First, the Stirling units 100 may be operated out of phase so as to cancel out the vibrations produced by each unit 100. Second, the pads 320, the isolation mechanism 360, and the isolation plugs 570 serve to "float" the Stirling units 100 so as to limit the amount of vibration even further.

It should be apparent that the foregoing relates only to the preferred embodiments of the present invention and that numerous changes and modifications may be made herein without departing from the spirit and scope of the invention as defined by the following claims.

What is claimed is:

1. A refrigerator, comprising:

a cabinet; and a refrigeration deck slidably positioned within said cabinet;

said refrigeration deck comprising a Stirling cooler unit.

2. The refrigerator of claim 1, wherein said Stirling cooler unit comprises a plurality of Stirling cooler units.

3. The refrigerator of claim 2, wherein said plurality of Stirling cooler units comprises a plurality of free piston Stirling cooler units.

4. The refrigerator of claim 3, wherein said plurality of Stirling cooler units comprises a first one of said plurality of Stirling cooler units out of phase with a second one of said plurality of Stirling cooler units so as to cancel out the vibrations produced by said plurality of Stirling cooler units.

5. The refrigerator of claim 1, wherein said Stirling cooler unit comprises a fan.

6. The refrigerator of claim 1, wherein said Stirling cooler unit comprises a hot end and a cold end.

7. The refrigerator of claim 6, wherein said refrigeration deck comprises a hot air shroud positioned adjacent to said hot end of said Stirling cooler unit.

8. The refrigerator of claim 6, wherein said refrigeration deck comprises a cold end heat exchanger positioned adjacent to said cold end of said Stirling cooler unit.

9. The refrigerator of claim 8, wherein said cold end heat exchanger comprises a plate and a plurality of fins attached thereto.

10. The refrigerator of claim 8, wherein said cold end of said Stirling cooler unit attaches to said cold end heat exchanger via an attachment ring.

11. The refrigerator of claim 1, wherein said cabinet comprises a refrigerated space and an air plenum such that said air may circulate through said air plenum between said refrigerated space and said refrigeration deck.

12. The refrigerator of claim 11, wherein said air plenum comprises a return air stream and a supply air stream.

13. The refrigerator of claim 12, wherein said refrigeration deck comprises a cold air shroud positioned adjacent to said air plenum.

14. The refrigerator of claim 13, wherein said refrigeration deck comprises a fan positioned within said cold air shroud so as to circulate air through said cabinet and said refrigeration deck.

15. The refrigerator of claim 1, wherein said refrigeration deck comprise a base plate with a plurality of runners thereon so as to slide said refrigeration deck in and out of said cabinet.

16. The refrigerator of claim 15, wherein each of said plurality of runners comprises an isolation pad.

17. The refrigerator of claim 15, wherein said refrigeration deck comprises a vertical wall extending from said base plate.

18. The refrigerator of claim 15, wherein said vertical wall comprises an aperture therein, said aperture sized to accommodate said Stirling cooler unit positioned therein.

19. The refrigerator of claim 18, wherein said refrigeration deck comprises an insulation plug positioned within said aperture.

20. The refrigerator of claim 1, wherein said refrigeration deck comprises an isolation mechanism, said isolation mechanism supporting said Stirling cooler unit.

21. The refrigerator of claim 20, wherein said isolation mechanism comprises an elastomeric layer positioned on a tray.

22. The refrigerator of claim 20, wherein said Stirling cooler unit comprises a pin and a vertical plate with a screw positioned thereon and wherein said tray comprises an up-turned tab with an unthreaded hole and a down-turned tab with a threaded hole, such that said pin may engage said unthreaded hole of said up-turned tab and said screw may pass through said vertical plate and into said threaded hole of said down-turned tab.

23. A refrigerator, comprising:

a cabinet; and a refrigeration deck;

said refrigeration deck comprising a plurality of Stirling cooler units;

said plurality of Stirling cooler units comprising a first one of said plurality of Stirling cooler units out of phase with a second one of said plurality of Stirling cooler units so as to cancel out the vibrations produced by said plurality of Stirling cooler units.

24. The refrigerator of claim 23, wherein said refrigeration deck comprises a plurality of isolation mechanisms, each said isolation mechanism supporting one of said plurality of Stirling cooler units.

25. The refrigerator of claim 24, wherein each of said plurality of isolation mechanisms comprises an elastomeric layer positioned on a tray.

26. The refrigerator of claim 23, wherein said refrigeration deck comprise a base plate with a plurality of isolation pads thereon.

27. The refrigerator of claim 26, wherein said refrigeration deck comprises a vertical wall extending from said base plate.

28. The refrigerator of claim 27, wherein said vertical wall comprises an aperture therein, said aperture sized to accommodate said Stirling cooler unit positioned therein.

29. The refrigerator of claim 28, wherein said refrigeration deck comprises an insulation plug positioned within said aperture.

30. A refrigeration deck for a refrigerator, comprising:

a surface extending in a first direction;

a second surface extending in a second direction, said second surface connected to said first surface;

said second surface comprising an aperture therein;

said second surface comprising an isolation tray positioned thereon; and a Stirling cooler unit, said Stirling cooler unit positioned on said isolation tray and extending through said aperture in said second surface.

* * * * *